US010185289B2

(12) United States Patent
Nozawa

(10) Patent No.: US 10,185,289 B2
(45) Date of Patent: Jan. 22, 2019

(54) ELECTRONIC TIMEPIECE

(71) Applicant: Seiko Epson Corporation, Tokyo (JP)

(72) Inventor: Toshiyuki Nozawa, Okaya (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/460,569

(22) Filed: Mar. 16, 2017

(65) Prior Publication Data

US 2017/0277132 A1 Sep. 28, 2017

(30) Foreign Application Priority Data

Mar. 28, 2016 (JP) ..... 2016-063675

(51) Int. Cl.
*G04C 10/04* (2006.01)
*G04R 20/02* (2013.01)

(52) U.S. Cl.
CPC ..... *G04C 10/04* (2013.01); *G04R 20/02* (2013.01)

(58) Field of Classification Search
CPC ..... G04C 10/04
See application file for complete search history.

(56) References Cited

U.S. PATENT DOCUMENTS

| | | | | |
|---|---|---|---|---|
| 5,790,477 | A | 8/1998 | Hauke | |
| 2013/0026980 | A1 | 1/2013 | Sugai | |
| 2013/0077450 | A1* | 3/2013 | Fleury | G04C 10/04 368/80 |
| 2014/0254328 | A1* | 9/2014 | Tamura | H03H 9/21 368/47 |

FOREIGN PATENT DOCUMENTS

| | | | |
|---|---|---|---|
| JP | 2000-512014 | A | 9/2000 |
| JP | 2010-223798 | A | 10/2010 |
| JP | 2012-150035 | A | 8/2012 |
| JP | 2013-029407 | A | 2/2013 |
| JP | 2015-135347 | A | 7/2015 |

* cited by examiner

*Primary Examiner* — Edwin A. Leon
*Assistant Examiner* — Jason Collins
(74) *Attorney, Agent, or Firm* — Harness, Dickey & Pierce, P.L.C.

(57) ABSTRACT

An electronic timepiece that has a plurality of operation modes and uses a secondary battery as a power supply includes a 2 o'clock side information display unit that displays a residual quantity of the secondary battery, a navigation start switch that receives a user manipulation, and a control unit that decides an execution operation mode to be executed by the electronic timepiece among the plurality of operation modes according to the user manipulation received by the navigation start switch and switches display of a residual quantity of a battery in the 2 o'clock side information display unit according to the execution operation mode.

9 Claims, 13 Drawing Sheets

5a

| OPERATION MODE | MINIMUM BATTERY RESIDUAL RATIO LEVEL |
|---|---|
| TIME DISPLAY MODE | 10% |
| NAVIGATION MODE | 50% |

5b

| NUMBER | COORDINATES OF POSITION |
|---|---|
| 1 | (x1, y1) |
| 2 | (x2, y2) |
| 3 | (x3, y3) |
| ⋮ | ⋮ |

FIG. 11

| OPERATION MODE | MINIMUM BATTERY RESIDUAL RATIO LEVEL |
|---|---|
| TIME DISPLAY MODE | 10% |
| COMPASS MODE | 20% |
| NAVIGATION MODE | 50% |

ELECTRONIC TIMEPIECE

BACKGROUND

1. Technical Field

The present invention relates to an electronic timepiece.

2. Related Art

JP-T-2000-512014 discloses a timepiece that executes navigation to a destination site using a digital display as in a liquid crystal display device.

Incidentally, in electronic timepieces that have a plurality of operation modes and use batteries as power supplies (hereinafter referred to as "electronic timepieces with a plurality of operation modes"), it is considered that a time display mode (an operation mode in which time is displayed) which is a basic function of a timepiece is preferred to other operation modes.

For example, in electronic timepieces with a plurality of operation modes, executable operation modes are reduced as battery residual quantities decrease. A minimum level of a battery residual ratio at which an operation mode is executable (hereinafter also referred to as a "minimum battery residual ratio level") is considered to be set for each operation mode so that only the time display mode is executable finally.

For example, in an electronic timepiece that has a navigation mode in which navigation is executed using a GPS function and a time display mode, as disclosed in JP-T-2000-512014, a battery residual ratio of 50% is set as a minimum battery residual ratio level in the navigation mode and a battery residual ratio of 10% is set as a minimum battery residual ratio level in the time display mode.

In this case, both the navigation mode and the time display mode can be executed between the battery residual ratios of 100% to 50%, but only the time display mode can be executed between the battery residual ratios of 50% to 10%.

However, in a case in which a minimum battery residual ratio level is set for each operation mode, it is difficult to intuitively understand an actual battery residual quantity in each operation mode when a battery residual quantity or a battery residual ratio is displayed simply in an electronic timepiece with a plurality of operation modes.

For example, as described above, in a situation in which a battery residual ratio of 50% is set as the minimum battery residual ratio level in the navigation mode and a battery residual ratio of 10% is set as the minimum battery residual ratio level in the time display mode, there is a concern of a user mistaking the actually unusable navigation mode for a usable navigation in a case in which a battery residual ratio of 48% is displayed.

SUMMARY

An advantage of some aspects of the invention is to provide a technology for realizing display so that the actual battery residual quantity can be easily understood intuitively in each operation mode.

An electronic timepiece according to an aspect of the invention has a plurality of operation modes and uses a battery as a power supply. The electronic timepiece includes: a display unit that displays a residual quantity of the battery; a manipulation unit that receives a user manipulation; and a control unit that decides an execution operation mode to be executed by the electronic timepiece among the plurality of operation modes according to the user manipulation received by the manipulation unit and switches display of a residual quantity of the battery on the display unit according to the execution operation mode.

According to the aspect of the invention, since the display of the battery residual quantity is switched according to the execution operation mode, it is possible to realize display so that the actual battery residual quantity can be easily understood intuitively in each operation mode.

In the electronic timepiece according to the aspect of the invention described above, it is preferable that, in each of the plurality of operation modes, a minimum level of the battery residual ratio necessary to execute the operation mode is set, the minimum level of the battery residual ratio is different for each operation mode, and the control unit switches display of the residual quantity of the battery on the display unit according to the minimum level of the battery residual ratio in the operation mode set as the execution operation mode.

According to the aspect of the invention with this configuration, since the display of the battery residual quantity is switched according to the minimum level of the battery residual ratio in the operation mode, it is possible to realize display so that the actual battery residual quantity can be easily understood intuitively in each operation mode.

In the electronic timepiece according to the aspect of the invention described above, it is preferable that, when the residual ratio of the battery becomes the minimum level of the battery residual ratio in the operation mode set as the execution operation mode, the control unit controls the display unit such that the display of the residual quantity of the battery indicates battery residual quantity of zero.

According to the aspect of the invention with this configuration, since the display of zero of the battery residual quantity on the display unit corresponds to zero (the minimum level of the battery residual ratio) of the actual battery residual quantity in the operation mode, it is possible to realize display so that the actual battery residual quantity can be easily understood intuitively in each operation mode.

In the electronic timepiece according to the aspect of the invention described above, it is preferable that, of the plurality of operation modes, one operation mode is a time display mode in which a time is preferably displayed, and the minimum level of the battery residual ratio in the time display mode is lower than the minimum level of the battery residual ratio in an operation mode other than the time display mode among the plurality of operation modes.

According to the aspect of the invention with this configuration, even when the battery residual quantity is small, the time display mode can be preferentially executed among the plurality of operation modes in addition to the above-described operational advantages. Therefore, the time display mode which is a basic function of a timepiece can be preferred to the other operation modes.

In the electronic timepiece according to the aspect of the invention described above, it is preferable that, of the plurality of operation modes, one operation mode is a navigation mode in which navigation to a destination site is executed, and in a case in which the execution operation mode becomes the navigation mode, the control unit estimates the number of times the navigation mode is executable according to the residual quantity of the battery and displays the number of times the navigation mode is executable as the display of the residual quantity of the battery on the display unit.

According to the aspect of the invention with this configuration, since an estimated value serving as a reference of the number of times the navigation mode is executable is displayed, it is possible to realize display so that it can easily be understood intuitively how many remaining times the navigation mode is usable.

BRIEF DESCRIPTION OF THE DRAWINGS

The invention will be described with reference to the accompanying drawings, wherein like numbers reference like elements.

FIG. 11 is a diagram illustrating an example of a destination site management table.

DESCRIPTION OF EXEMPLARY EMBODIMENTS

First Embodiment

Figure 1:
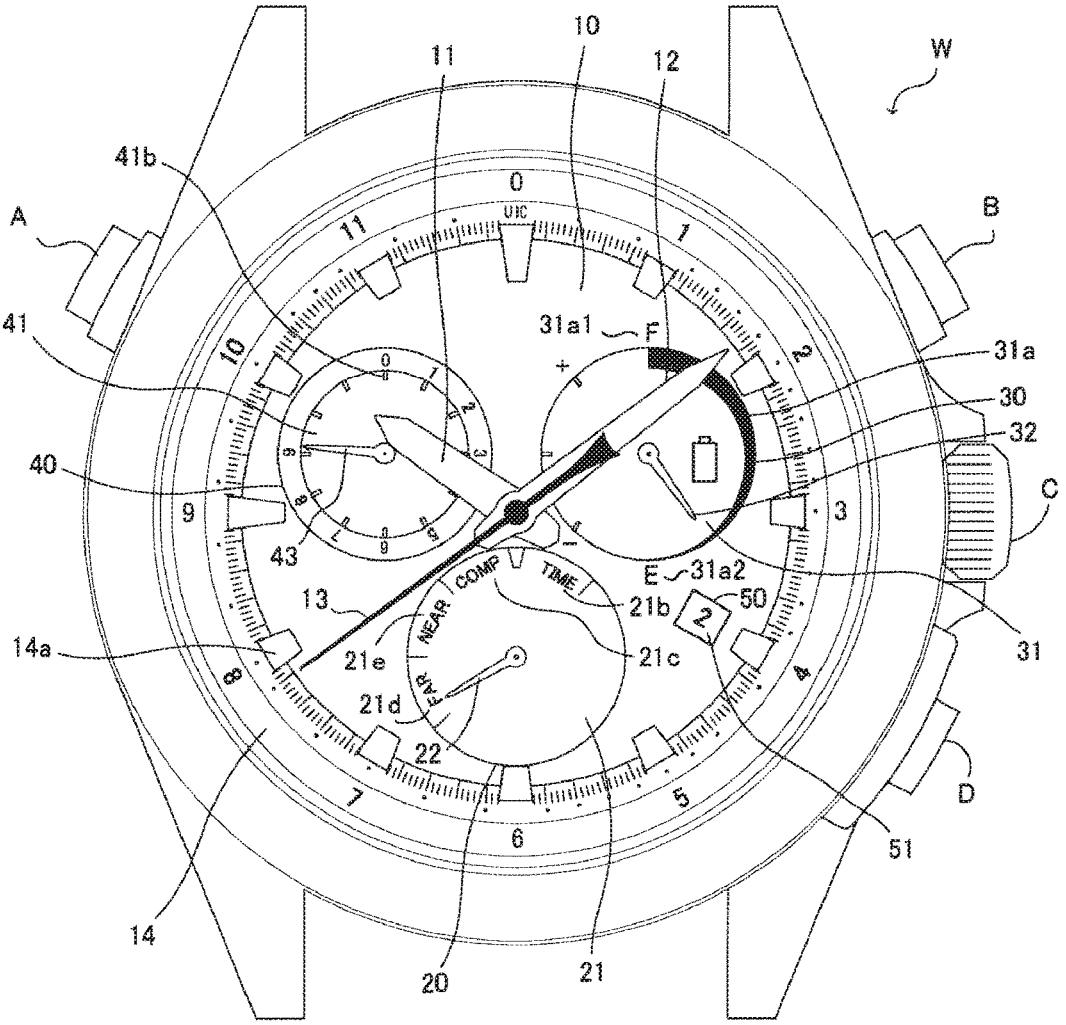
FIG. 1 is a plan view illustrating an electronic timepiece according to a first embodiment.

Hereinafter, embodiments of the invention will be described with reference to the drawings. The dimensions and scales of the units in the drawing are appropriately different from actual dimensions and scales. Since the embodiments to be described below are specific examples suitable for the invention, various technically preferred limitations are imposed. The scope of the invention is not limited to such forms unless otherwise mentioned to particularly limit the invention in the following description.

FIG. 1 is a plan view illustrating an electronic timepiece W with a sensor (hereinafter simply referred to as an "electronic timepiece") according to the embodiment.

Overview of Electronic Timepiece W

First, an overview of the electronic timepiece W will be described.

The electronic timepiece W uses a battery as a power supply and displays a battery residual quantity on a 2 o'clock side information display unit 30 installed on a 2 o'clock side of a time display unit 10. The electronic timepiece W has a plurality of operation modes. The electronic timepiece W has a navigation mode in which navigation to a destination site is executed and a time display mode in which a time is displayed as operation modes.

To prefer the time display mode, which is a basic function of a timepiece when a battery residual quantity is small, to the navigation mode in the electronic timepiece W, a minimum level of a battery residual ratio at which the time display mode is executable is set to be lower than a minimum level of a battery residual ratio at which the navigation mode is executable.

The battery residual ratio indicates 100% when the battery residual quantity is a full state, and indicates 0% when the battery residual quantity is an empty state.

Figure 2:
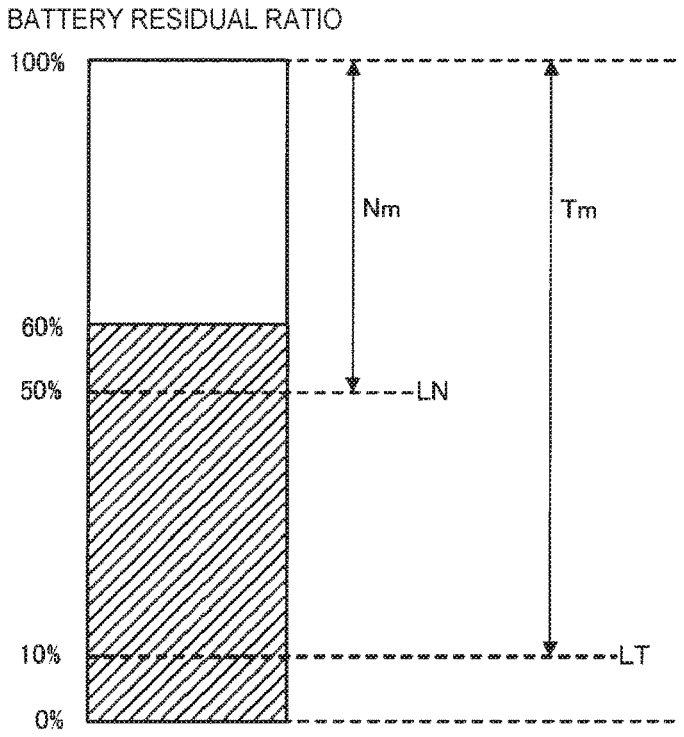
FIG. 2 is a diagram illustrating a minimum battery residual ratio level of each operation mode.

In the embodiment, as illustrated in FIG. 2, a battery residual ratio of 10% is used as a minimum level of a battery residual ratio (minimum battery residual ratio level) LT at which the time display mode is executable. A battery residual ratio of 50% is used as a minimum level of the battery residual ratio (minimum battery residual ratio level) LN at which the navigation mode is executable. Accordingly, the time display mode is executable between battery residual ratios of 100% to 10% (in a range Tm illustrated in FIG. 2). The navigation mode is executable between battery residual ratios of 100% to 50% (in a range Nm illustrated in FIG. 2). In FIG. 2, a battery residual ratio of 60% is also illustrated.

In the example illustrated in FIG. 2, both of the navigation mode and the time display mode are executable between the battery residual ratios of 100% to 50%. Of the navigation mode and the time display mode, only the time display mode is executable between the battery residual ratios of 50% to 10%. Accordingly, the time display mode is preferred to the navigation mode.

However, the minimum battery residual ratio level LN (=50%) of the navigation mode is different from the minimum battery residual ratio level LT (=10%) of the time display mode. Therefore, as illustrated in FIG. 2, in a case in which the battery residual ratio (=60%) is merely indicated, it may be difficult to intuitively understood an actual battery residual quantity in each operation mode.

In the description of the example illustrated in FIG. 2, the battery residual ratio is 60% and the minimum battery residual ratio level LN in the navigation mode is 50%. Therefore, an actual battery residual ratio in the navigation mode is 20% (=(60%−50%)/(100%−50%)). However, it is difficult to intuitively recognize the actual battery residual ratio of 20% in the navigation mode from the battery residual ratio of 60% illustrated in FIG. 2.

Since the battery residual ratio is 60% and the minimum battery residual ratio level LT of the time display mode is 10%, an actual battery residual ratio in the time display mode is 56% (=(60%−10%)/(100%−10%)). However, it is difficult to intuitively recognize the actual battery residual ratio of 56% in the time display mode from the battery residual ratio of 60% illustrated in FIG. 2.

Accordingly, the electronic timepiece W switches display of a battery residual quantity displayed in the 2 o'clock side information display unit 30 according to an operation mode (hereinafter referred to as an "execution operation mode") executed by the electronic timepiece W.

For example, in a case in which the execution operation mode is the time display mode, the 2 o'clock side information display unit 30 displays a battery residual quantity so that a full quantity (100%) is indicated when the battery residual ratio is 100% and an empty quantity (0%) is indicated when the battery residual ratio is 10% (=the minimum battery residual ratio level of the time display mode).

On the other hand, in a case in which the execution operation mode is the navigation mode, the 2 o'clock side information display unit 30 displays a battery residual quantity so that a full quantity (100%) is indicated when the battery residual ratio is 100% and an empty quantity (0%) is indicated when the battery residual ratio is 50% (=the minimum battery residual ratio level of the navigation mode).

The 2 o'clock side information display unit 30 is an example of a display unit that displays a battery residual quantity. In the embodiment, the 2 o'clock side information display unit 30 displays a battery residual ratio as the battery residual quantity.

The minimum battery residual ratio level LT of the time display mode and the minimum battery residual ratio level LN of the navigation mode are not limited to 10% and 50%, respectively. The minimum battery residual ratio level of the time display mode may be lower than the minimum battery residual ratio level of the navigation mode.

Navigation Mode

In a case in which the execution operation mode is the navigation mode, the electronic timepiece W can execute, for example, navigation for returning to a departure site. For navigation, a site registration switch A and a navigation start switch B are used.

Overview of Site Registration Operation

When a user continuously presses the site registration switch A at a departure site for a specific time (for example, 2 seconds) or more, the electronic timepiece W acquires the coordinates (position coordinates) of the departure site and retains the coordinates. The coordinates of the departure site are used as coordinates of a destination site. The electronic timepiece W acquires the coordinates of a departure site (current site) by GPS. Therefore, the coordinates of a position are indicated as longitude and latitude. The specified time is not limited to 2 seconds and can be appropriately modified.

Overview of Navigation Operation

When the user moves to another site carrying the electronic timepiece W after site registration and the user continuously presses the navigation start switch B for a predetermined time (for example, 2 seconds) or more in a situation in which the execution operation mode of the electronic timepiece W is set to the time display mode, the electronic timepiece W switches the execution operation mode from the time display mode to the navigation mode. The predetermined time is not limited to 2 seconds, but can be appropriately changed.

The electronic timepiece W acquires the coordinates of the current site once or periodically by GPS and acquires the north direction periodically using a magnetic sensor to be described below in the navigation mode.

In the navigation mode, whenever the electronic timepiece W acquires the coordinates of the current site, the electronic timepiece W calculates a distance from the current site to the departure site (hereinafter referred to as a "distance up to the departure site") and an azimuth of the departure site (hereinafter referred to as an "azimuth of the departure site") viewed from the current site using the coordinates of the departure site and the coordinates of a recent current site.

When the electronic timepiece W calculates the direction of the departure site and the distance up to the departure site, the electronic timepiece W executes navigation for returning to the departure site by switching and pointing the direction of the destination site and the direction of the due north by a pointing hand 13 on the assumption that the north direction acquired using the magnetic sensor is a reference and by displaying a distance up to the destination site with a distance display hand 43. The indication direction of the pointing hand 13 is switched according to a pressing manipulation of the azimuth display changeover switch D.

In a case in which the navigation start switch B is continuously pressed for a predetermined time (for example, 2 seconds) or the navigation mode continues for a given time (for example, 2 minutes) in a situation in which the execution operation mode is the navigation mode, the execution operation mode is switched from the navigation mode to the time display mode.

Using GPS

Next, a method in which the electronic timepiece W obtains the coordinates of the current site (positional information) and time information using radio waves (radio waves from GPS satellites) will be described.

Figure 3:
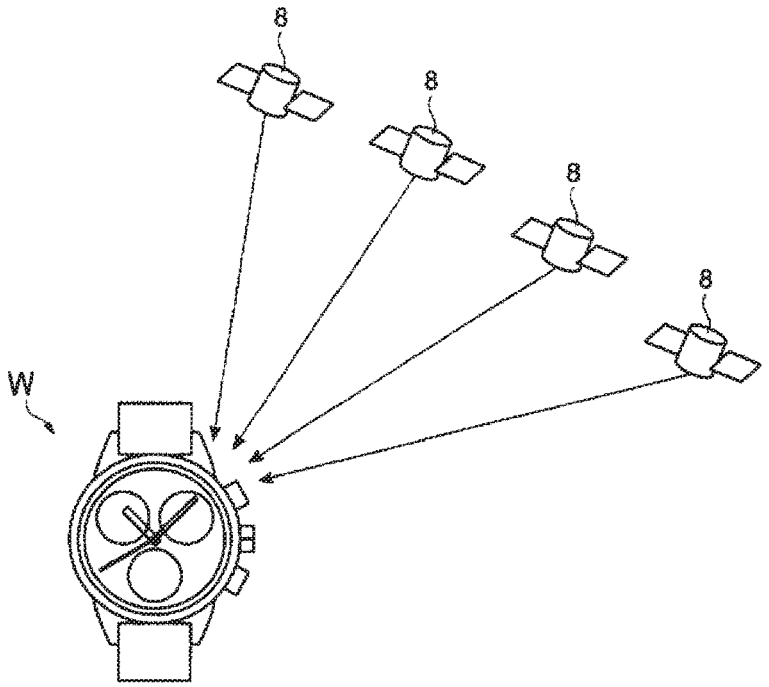
FIG. 3 is an overall diagram illustrating GPS including the electronic timepiece.

FIG. 3 is an overall diagram illustrating GPS including the electronic timepiece W.

The electronic timepiece W is a wristwatch that receives radio waves from GPS satellites 8 and corrects a measured time of an internal timepiece (an RTC 1 to be described below). The electronic timepiece W displays time or the like on an opposite surface (hereinafter referred to as a "front surface") to a surface (hereinafter referred to as a "rear surface") on a side coming into contact with an arm. The GPS satellites 8 are navigation satellites that turn around a predetermined orbit above the Earth. The GPS satellites 8 transmit radio waves (L1 waves) with 1.57542 GHz on which a navigation message is superimposed, to the ground. In the following description, radio waves with 1.57542 GHz on which a navigation message is superimposed are referred to as satellite signals. The satellite signals are circularly polarized waves of right handed polarized waves.

At present, there are about 31 GPS satellites 8 (in FIG. 3, only four satellites are illustrated). To identify which satellite signal is transmitted from which GPS satellite 8, each GPS satellite 8 superimposes a unique pattern with 1023 bits (a period of 1 ms) called a C/A code (coarse/acquisition code) on a satellite signal. Each bit is one of +1 and −1. Therefore, the C/A code is seen to be a random pattern.

An atomic clock is mounted on the GPS satellite 8. The satellite signal includes considerably accurate GPS time information measured by the atomic clock. A time error of the atomic clock mounted on each GPS satellite 8 is measured by a ground control segment. The satellite signal also includes a time correction parameter for correcting that time error. The electronic timepiece W receives a satellite signal (radio waves) transmitted from one GPS satellite 8 and matches a clocking time of the internal clock (the RTC 1) with an accurate time (time information) obtained using the time correction parameter and the GPS time information included in the satellite signal.

The satellite signal also includes an orbit information indicating a position of the GPS satellite 8 on the orbit. The electronic timepiece W can execute positioning calculation using the GPS time information and the orbit information.

The positioning calculation is executed on the assumption that an error is included in a measured time of the internal timepiece of the electronic timepiece W to some extent. That is, a time error is also unknown in addition to x, y, and z parameters for specifying a 3-dimensional position of the electronic timepiece W. Therefore, the electronic timepiece W receives satellite signals transmitted generally from four or more GPS satellites 8, executes the positioning calculation using the GPS time information and the orbit information included in the satellite signals, and obtains positional information of the current site (the coordinates of the current site).

Referring back to FIG. 1, the description will be made.

The electronic timepiece W includes the time display unit 10, the site registration switch A, the navigation start switch B, a crown switch C, and an azimuth display changeover switch D.

The time display unit 10 includes an hour hand 11, a minute hand 12, the pointing hand 13, a dial ring 14, a 6 o'clock side information display unit 20 installed on the 6 o'clock side, the 2 o'clock side information display unit 30 installed on the 2 o'clock side, a 10 o'clock side information display unit 40 installed on the 10 o'clock side, and a date display unit 50.

In the dial ring 14, a 12-hour clock scale 14*a* is formed in a circular form.

The time display unit 10 displays time with the hour hand 11 and the minute hand 12 using the scale 14*a* as a reference regardless of the operation mode. The pointing positions of the hour hand 11 and the minute hand 12 are changed, for example, according to a manipulation of the crown switch C.

The time display unit 10 displays a second of time with the pointing hand 13 in the time display mode. The time display unit 10 switches and indicates the direction of the destination site and the direction of the due north with the pointing hand 13 in the navigation mode.

The 6 o'clock side information display unit 20 includes a letter plate 21 and a mode pointing hand 22.

On the letter plate 21, letters indicating the operation modes are written. Specifically, on the letter plates 21, a letter 21*b* of "TIME" indicating the time display mode, a letter 21*c* of "COMP", a letter 21*d* of "FAR", and a letter 21*e* of "NEAR" are written.

The 6 o'clock side information display unit 20 displays the time display mode as the execution operation mode by pointing the letter 21*b* of "TIME" by the mode pointing hand 22. The 6 o'clock side information display unit 20 displays the navigation mode as the execution operation mode by pointing any of the letter 21*c* of "COMP", the letter 21*d* of "FAR", and the letter 21*e* of "NEAR" by the mode pointing hand 22.

In other words, the 6 o'clock side information display unit 20 indicates the letter 21*c* of "COMP" on the letter plate 21 with the mode pointing hand 22 in a case in which the pointing hand 13 points the direction of the due north. The 6 o'clock side information display unit 20 indicates the letter 21*d* of "FAR" or the letter 21*e* of "NEAR" with the mode pointing hand 22 in a case in which the pointing hand 13 points the direction of the destination site.

In a case in which a distance up to the destination site is 1 km or more in a state in which the pointing hand 13 points the direction of the destination site, the mode pointing hand 22 points the letter 21*d* of "FAR" on the letter plate 21. In a case in which the mode pointing hand 22 points the letter 21*d* of "FAR", a scale 41*b* of numerical values written on a letter plate 41 of the 10 o'clock side information display unit 40 is used in units of 1 km and a distance range of a distance up to the destination site is 10 km. Since the mode pointing hand 22 points the letter 21*d* of "FAR" in the example illustrated in FIG. 1, a distance display hand 43 displays 9 km.

Conversely, in a case in which the distance up to the destination site is less than 1 km in the state in which the pointing hand 13 points the direction of the destination site, the mode pointing hand 22 points the letter 21*e* of "NEAR" on the letter plate 21. In a case in which the mode pointing hand 22 points the letter 21*e* of "NEAR", the scale 41*b* of numerical values of the 10 o'clock side information display unit 40 is used in units of 100 m and a distance range up to the distance of the destination site is 1000 m. For example, when the mode pointing hand 22 points the letter 21*e* of "NEAR" in the example illustrated in FIG. 1, it is indicated that the distance display hand 43 points 900 m.

The 2 o'clock side information display unit 30 includes a letter plate 31 and a residual quantity pointing hand 32.

A residual quantity meter 31*a* indicating a residual quantity of a battery used as a power supply of the electronic timepiece W is installed on the letter plate 31. In the residual quantity meter 31*a*, a letter 31*a*1 of "F" is installed at a position corresponding to a battery residual ratio of 100% and a letter 31*a*2 of "E" is installed at a position corresponding to the battery residual ratio of 0% (zero).

The 2 o'clock side information display unit 30 displays a residual quantity of the battery by pointing the residual quantity meter 31*a* by the residual quantity pointing hand 32. The 2 o'clock side information display unit 30 switches display of the battery residual quantity according to the execution operation mode.

As described above, in a case in which the execution operation mode is the time display mode, the 2 o'clock side information display unit 30 displays the battery residual quantity so that the residual quantity pointing hand 32 points the letter 31*a*1 of "F" meaning a full quantity (100%) when the battery residual ratio is 100%, and the residual quantity pointing hand 32 points the letter 31*a*2 of "E" meaning zero (0%) when the battery residual ratio is 10% (=the minimum battery residual ratio level of the time display mode).

Conversely, in a case in which the execution operation mode is the navigation mode, the 2 o'clock side information display unit 30 displays the battery residual quantity so that the residual quantity pointing hand 32 points the letter 31*a*1 of "F" meaning the full quantity (100%) when the battery residual ratio is 100%, and the residual quantity pointing hand 32 points the letter 31*a*2 of "E" meaning zero (0%) when the battery residual ratio is 50% (=the minimum battery residual ratio level of the navigation mode).

The 10 o'clock side information display unit 40 includes a letter plate 41 and a distance display hand 43.

On the letter plate 41, a scale 41*b* of 0 to 9 is formed in a circular form.

In the case in which the execution operation mode is the navigation mode, the 10 o'clock side information display unit 40 displays a distance up to the destination site with the distance display hand 43 using the scale 41*b* as a reference.

The date display unit 50 includes a date wheel 51 displaying a date of a calendar.

Figure 4:
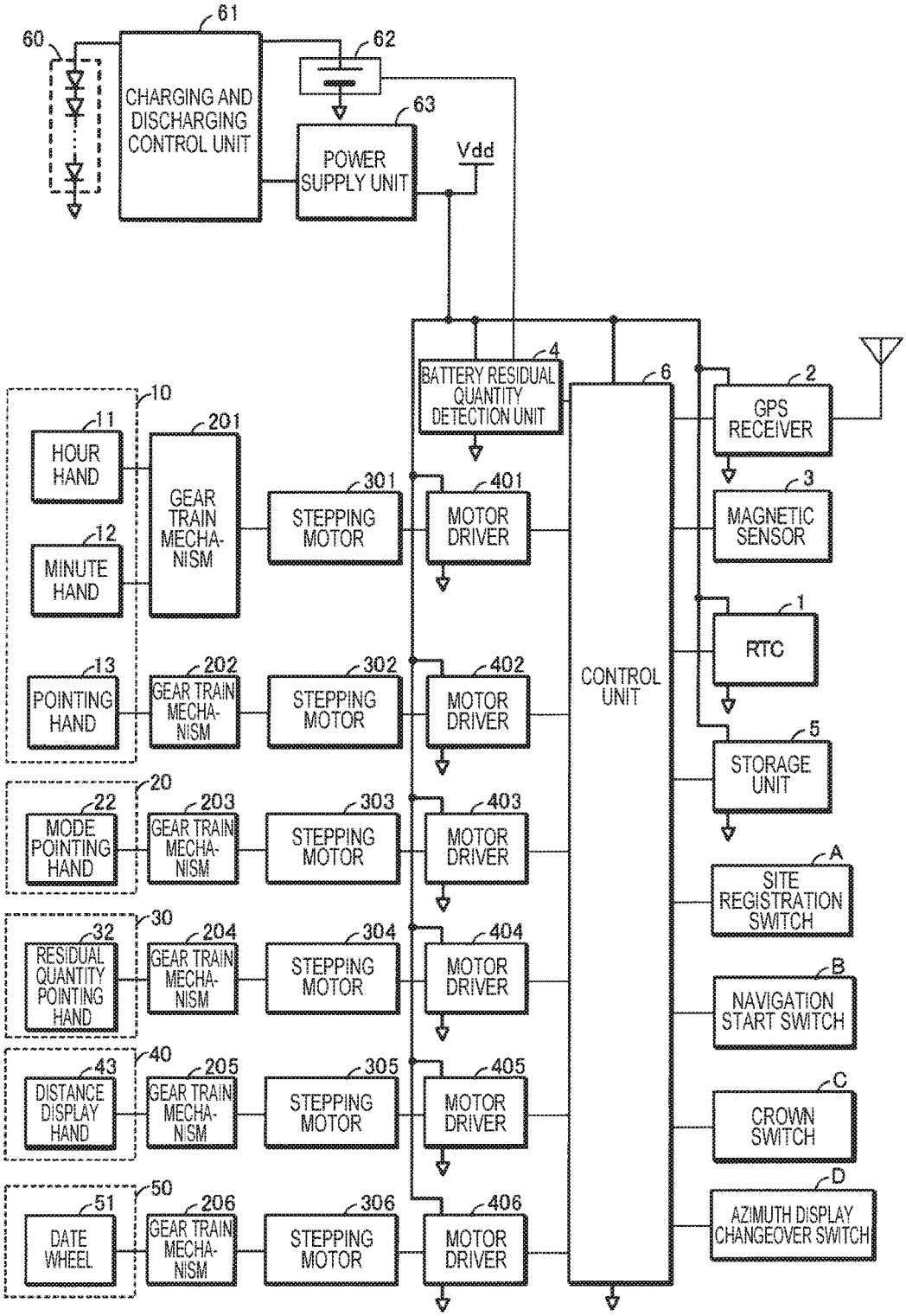
FIG. 4 is a diagram illustrating the configuration of the electronic timepiece.

FIG. 4 is a diagram illustrating the configuration of the electronic timepiece W. In FIG. 4, the same reference numerals are given to the same constituent elements as those illustrated in FIG. 1.

The electronic timepiece W includes a solar battery 60, a charging and discharging control unit 61, a secondary battery 62, and a power supply unit 63. The secondary battery 62 is used as a power supply of the electronic timepiece W. The charging and discharging control unit 61 charges the secondary battery 62 with power generated by the solar battery 60 and supplies the power of the secondary battery 62 to the power supply unit 63. The power supply unit 63 generates an internal power voltage Vdd using the power supplied from the secondary battery 62. The internal power supply Vdd is supplied to the RTC 1, a GPS receiver 2, a battery residual quantity detection unit 4, a storage unit 5, a control unit 6, and motor drivers 401 to 406 to be described below.

As a configuration related to the time display unit 10, the electronic timepiece W includes the hour hand 11, the minute hand 12, the pointing hand 13, gear train mechanisms 201 and 202, stepping motors 301 and 302, and motor drivers 401 and 402. The motor driver 401 drives the stepping motor 301 to drive the hour hand 11 and the minute hand 12 via the gear train mechanism 201. The motor driver 402 drives the stepping motor 302 to drive the pointing hand 13 via the gear train mechanism 202.

As a configuration related to the 6 o'clock side information display unit 20, the electronic timepiece W includes the mode pointing hand 22, a gear train mechanism 203, a stepping motor 303, and a motor driver 403. The motor driver 403 drives the stepping motor 303 to drive the mode pointing hand 22 via the gear train mechanism 203.

As a configuration related to the 2 o'clock side information display unit 30, the electronic timepiece W includes the residual quantity pointing hand 32, the gear train mechanism 204, the stepping motor 304, and the motor driver 404. The motor driver 404 drives the stepping motor 304 to drive the residual quantity pointing hand 32 via the gear train mechanism 204.

As a configuration related to the 10 o'clock side information display unit 40, the electronic timepiece W includes the distance display hand 43, a gear train mechanism 205, a stepping motor 305, and a motor driver 405. The motor driver 405 drives the stepping motor 305 to drive the distance display hand 43 via the gear train mechanism 205.

As a configuration related to the date display unit 50, the electronic timepiece W includes the date wheel 51, a gear train mechanism 206, a stepping motor 306, and a motor driver 406. The motor driver 406 drives the stepping motor 306 to drive the date wheel 51 via the gear train mechanism 206.

The electronic timepiece W further includes the real time clock (RTC) 1, the GPS receiver 2, a magnetic sensor 3, the battery residual quantity detection unit 4, the storage unit 5, and the control unit 6.

The RTC 1 measures a time using a reference signal output from a crystal resonator (not illustrated).

The GPS receiver 2 receives satellite signals (radio waves) transmitted from the GPS satellites 8.

The magnetic sensor 3 detects geomagnetism, that is, the magnetic north.

The battery residual quantity detection unit 4 detects a residual ratio R of the secondary battery 62 which is a power supply. For example, the battery residual quantity detection unit 4 detects a voltage of the secondary battery 62 and detects the residual ratio R of the secondary battery 62 from the voltage. In the embodiment, the battery residual quantity detection unit 4 periodically detects the residual ratio R of the secondary battery 62 while the electronic timepiece W is operating.

The storage unit 5 is, for example, a non-transitory storage medium and records a computer program. The storage unit 5 records a relation table indicating a relation between an operation mode and a minimum battery residual ratio level.

Figures 5, 6:
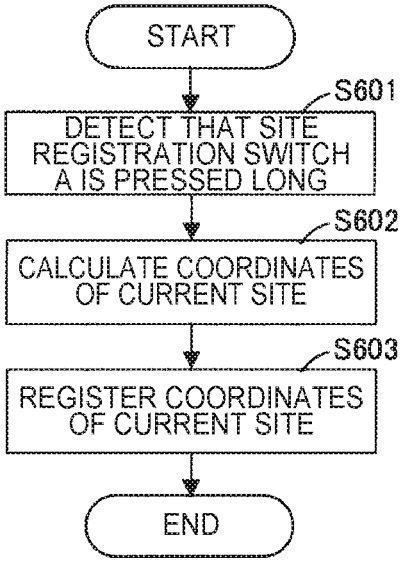
FIG. 5 is a diagram illustrating an example of a relation table.
FIG. 6 is a flowchart illustrating a site registration operation.

FIG. 5 is a diagram illustrating an example of a relation table 5*a*.

In the relation table 5*a* illustrated in FIG. 5, the navigation mode and the time display mode are set as the operation modes, 10% is set as the minimum battery residual ratio level LT of the time display mode, and 50% is set as the minimum battery residual ratio level LN of the navigation mode. Therefore, the minimum battery residual ratio level LT of the time display mode is lower than the minimum level of the battery residual ratio of the operation mode (the navigation mode) other than the time display mode among the plurality of operation modes.

Referring back to FIG. 4, the description will be made. The control unit 6 is, for example, a CPU and realizes various functions by reading a computer program stored in the storage unit 5 and executing the computer program.

For example, the control unit 6 specifies the coordinates (position coordinates) of the current site using the satellite signals received by the GPS receiver 2. The control unit 6 executes navigation to the departure site (destination site) using the pointing hand 13 and the distance display hand 43.

The control unit 6 decides the execution operation mode of the electronic timepiece W between the time display mode and the navigation mode according to continuous pressing of the navigation start switch B for the predetermined time (for example, 2 seconds) or more. According to this decision, the execution operation mode of the electronic timepiece W is switched.

For example, when the control unit 6 detects that the navigation start switch B is continuously pressed for the predetermined time (for example, 2 seconds) or more in the situation in which the execution operation mode is the time display mode, the control unit 6 switches the execution operation mode from the time display mode to the navigation mode. When the control unit 6 detects that the navigation start switch B is continuously pressed for the predetermined time (for example, 2 seconds) or more in the situation in which the execution operation mode is the navigation mode, the control unit 6 switches the execution operation mode from the navigation mode to the time display mode.

The navigation start switch B is an example of a manipulation unit that receives a user manipulation. The manipulation of continuously pressing the navigation start switch B for the predetermined time (for example, 2 seconds) or more is an example of a user manipulation received by the manipulation unit. The manipulation unit receiving a user manipulation is not limited to the navigation start switch B, but can be appropriately changed. For example, in a case in which the electronic timepiece W includes a mode changeover switch that switches the execution operation mode, the mode changeover switch is an example of the manipulation unit that receives a user manipulation.

Further, in a case in which the navigation mode continues for a given time (for example, 2 minutes), the control unit 6 switches the execution operation mode from the navigation mode to the time display mode.

Further, according to the execution operation mode, the control unit 6 switches display of a battery residual quantity in the 2 o'clock side information display unit 30. At this time, the control unit 6 switches display of a battery residual quantity in the 2 o'clock side information display unit 30 according to the battery residual ratio R of the secondary battery 62 and the execution operation mode.

Description of Operation

Next, an operation of the electronic timepiece W will be described focusing on display of a battery residual quantity.

Site Registration Operation

FIG. 6 is a flowchart illustrating a site registration operation.

For example, when the control unit 6 detects that the site registration switch A is continuously pressed for a specific time (for example, 2 seconds) or more in the departure site (the site registration switch A is pressed long) (step S601), the control unit 6 activates the GPS receiver 2 and receives satellite signals transmitted from the GPS satellites 8 via the GPS receiver 2. Subsequently, the control unit 6 calculates the coordinates of the current site using the satellite signals (step S602). Subsequently, the control unit 6 stores (registers) the coordinates of the current site in the storage unit 5 (step S603). The coordinates stored in the storage unit 5 are used as destination site information indicating the position of the destination site.

Navigation Operation

Figure 7:
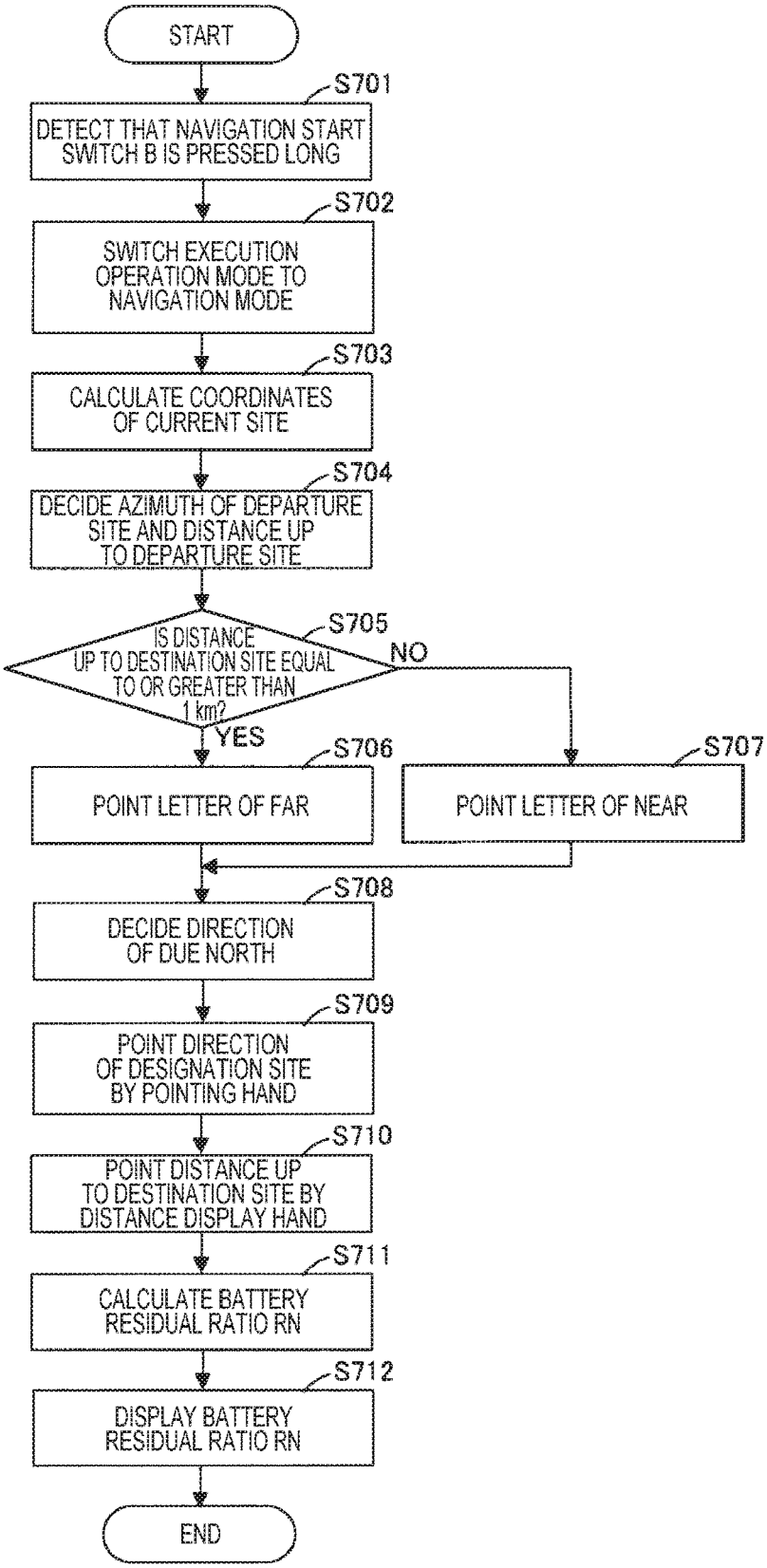
FIG. 7 is a flowchart illustrating a navigation operation.

FIG. 7 is a flowchart illustrating the navigation operation.

When the control unit 6 detects that the navigation start switch B is continuously pressed for a predetermined time (for example, 2 seconds) or more (the navigation start switch B is pressed long in the time display mode) in the situation in which the execution operation mode is the time display mode (step S701), the control unit 6 switches the execution operation mode from the time display mode to the navigation mode (step S702).

Subsequently, the control unit 6 activates the GPS receiver 2 and receives the satellite signals transmitted from the GPS satellites 8 via the GPS receiver 2. Subsequently, the control unit 6 calculates the coordinates of the current site using the satellite signals (step S703).

Subsequently, the control unit 6 uses the coordinates stored in the storage unit 5 as destination site information and decides the azimuth of the departure site viewed from the current site and the distance between the current site and the departure site (the distance up to the departure site) using the destination site information (the coordinates of the destination site) and the coordinates of a recent current site (step S704).

Subsequently, the control unit 6 determines whether the distance up to the departure site is equal to or greater than 1 km (step S705).

In a case in which the distance up to the departure site is equal to or greater than 1 km (YES in step S705), the control unit 6 controls the motor driver 403 such that the mode pointing hand 22 points the letter 21*d* of "FAR" on the letter plate 21 in the 6 o'clock side information display unit 20 (step S706).

Conversely, in a case in which the distance up to the departure site is less than 1 km (NO in step S705), the control unit 6 controls the motor driver 403 such that the mode pointing hand 22 points the letter 21*e* of "NEAR" on the letter plate 21 in the 6 o'clock side information display unit 20 (step S707).

Subsequently, the control unit 6 activates the magnetic sensor 3 and decides the direction of a magnetic north based on an output of the magnetic sensor 3. Subsequently, the control unit 6 corrects the direction of the magnetic north using information regarding a declination angle stored in advance in the storage unit 5 and decides the direction of the due north (step S708). In a case in which the storage unit 5 stores a declination angle table indicating a relation between the declination angle and the position coordinates, the control unit 6 may read the declination angle corresponding to the coordinates of the current site from the declination angle table, correct the direction of the magnetic north using the read declination angle, and decide the direction of the due north.

Subsequently, the control unit 6 controls the motor driver 402 such that the pointing hand 13 points the direction of the destination site (step S709). Here, the control unit 6 decides the direction of the destination site based on the azimuth of the departure site and the direction of the due north.

Subsequently, the control unit 6 controls the motor driver 405 such that the distance display hand 43 displays the distance up to the destination site in the 10 o'clock side information display unit 40 (step S710).

In a case in which the mode pointing hand 22 points the letter 21*d* of "FAR" on the letter plate 21 in step S710, that is, the distance up to the destination site is equal to or greater than 1 km, the control unit 6 uses the scale 41*b* of numerical values of the 10 o'clock side information display unit 40 as units of 1 km. Therefore, a distance range of the distance up to the destination site is 10 km.

Conversely, in a case in which the mode pointing hand 22 points the letter 21*e* of "NEAR" on the letter plate 21, that is, the distance up to the destination site is less than 1 km, the control unit 6 uses the scale 41*b* of numerical values of the 10 o'clock side information display unit 40 as units of 100 m. Therefore, a distance range of the distance up to the destination site is 1000 m.

Subsequently, the control unit 6 acquires the residual ratio R of the secondary battery 62 from the battery residual quantity detection unit 4 and reads the minimum battery residual ratio level LN (=50%) of the navigation mode from the relation table 5*a* (see FIG. 5) of the storage unit 5. Subsequently, the control unit 6 calculates the battery residual ratio RN in the navigation mode using Equation (1) below (step S711).

$$RN=(R-LN)/(100\%-LN) \qquad \text{Equation (1)}$$

For example, in a case in which the residual ratio R of the secondary battery 62 is 60%, the battery residual ratio RN in the navigation mode is as follows from equation (1).

$$RN=(60\%-50\%)/(100\%-50\%)=20\%$$

Subsequently, the control unit 6 controls the motor driver 404 such that the residual quantity pointing hand 32 of the 2 o'clock side information display unit 30 points the battery residual ratio RN (step S712).

When a manipulation of pressing the azimuth display changeover switch D is received at a time at which the pointing hand 13 points the direction of the destination site, the control unit 6 controls the motor driver 402 such that the direction pointed by the pointing hand 13 is switched to the direction of the due north. When the manipulation of pressing the azimuth display changeover switch D is received at a time at which the pointing hand 13 points the direction of the due north, the control unit 6 controls the motor driver 402 such that the direction pointed by the pointing hand 13 is switched to the direction of the destination site. Therefore, the pointing hand 13 alternately points the direction of the destination site and the direction of the due north according to the manipulation of pressing the azimuth display changeover switch D.

In a case in which the pointing hand 13 points the direction of the due north, the control unit 6 controls the motor driver 403 such that the mode pointing hand 22 points the letter 21*c* of "COMP" on the letter plate 21 in the 6 o'clock side information display unit 20.

Conversely, in a case in which the pointing hand 13 points the direction of the destination site, the control unit 6 controls the motor driver 403 such that the mode pointing hand 22 points the letter 21*d* of "FAR" on the letter plate 21 in the 6 o'clock side information display unit 20 when the distance up to the destination site is equal to or greater than 1 km. In a case in which the pointing hand 13 points the direction of the destination site, the control unit 6 controls the motor driver 403 such that the mode pointing hand 22 points the letter 21*e* of "NEAR" on the letter plate 21 in the 6 o'clock side information display unit 20 when the distance up to the destination site is less than 1 km.

Therefore, whether the pointing hand 13 points the direction of the destination site or points the direction of the due north can be determined with a letter pointed by the mode pointing hand 22 of the 6 o'clock side information display unit 20. Thus, two pieces of azimuth information (the direction of the destination site and the direction of the due north) can be displayed with one pointing hand 13.

Hereinafter, while the navigation mode continues, the control unit 6 periodically executes calculation of the coordinates of the current site using the satellite signals, an operation of deciding the direction of the due north using an output of the magnetic sensor 3, an operation of deciding the distance between the current site and the departure site using the destination site information and the coordinates of the current site, and an operation of deciding the direction of the destination site using the destination site information, the coordinates of the current site, and the direction of the due north, and then periodically updates display of the direction of the destination site, the direction of the due north, and the distance up to the destination site using these results.

When the residual ratio R of the secondary battery 62 is the minimum battery residual ratio level LN (=50%) of the navigation mode, the control unit 6 switches the execution operation mode from the navigation mode to the time display mode and ends the navigation mode.

To save power, the control unit 6 stops the operation of deciding the due north using the magnetic sensor 3, the direction pointing operation by the pointing hand 13, and the distance display operation by the distance display hand 43 and displays a time with the hour hand 11, the minute hand 12, and the pointing hand 13 in a case in which a time in which the navigation mode continues as the execution operation mode exceeds a predetermined threshold time (for example, 2 minutes). For example, the control unit 6 may forcibly change the execution operation mode from the navigation mode to the time display mode in a case in which the time in which the navigation mode continues as the execution operation mode exceeds the predetermined threshold time. The predetermined threshold time is not limited to 2 minutes and can be appropriately changed.

As another method of saving power, the calculation of the coordinates of the current site using the satellite signals may be executed only once through a manipulation executed once on the navigation start switch B, and only the operation of deciding the direction of the due north using the output of the magnetic sensor 3 may be executed periodically. In this case, the direction of the destination site and the direction of the due north are periodically updated without updating the distance up to the destination site. In a case in which the user stays at the same position and only the direction is changed, this operation suffices.

Time Display Operation

Figure 8:
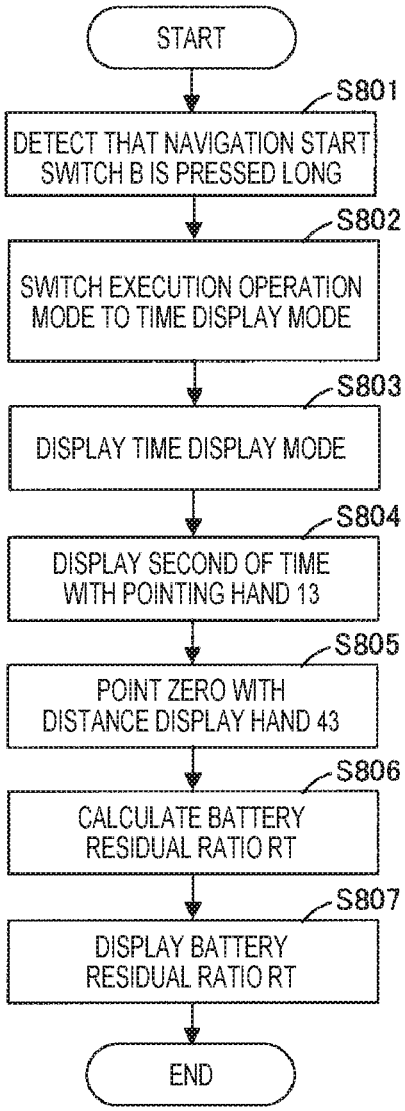
FIG. 8 is a flowchart illustrating an operation in a time display mode.

FIG. 8 is a flowchart illustrating an operation in the time display mode.

When the control unit 6 detects that the navigation start switch B is continuously pressed for the predetermined time (for example, 2 seconds) or more (the navigation start switch B is pressed long in the navigation mode) in the situation in which the execution operation mode is the navigation mode (step S801), the control unit 6 switches the execution operation mode to the time display mode (step S802). Even in a case in which the navigation mode continues in a given time (for example, 2 minutes), the control unit 6 switches the execution operation mode from the navigation mode to the time display mode.

Subsequently, the control unit 6 controls the motor driver 403 so that the mode pointing hand 22 points the letter 21*b* of "TIME" on the letter plate 21 and displays the time display mode (step S803).

Subsequently, the control unit 6 controls the motor driver 402 so that the pointing hand 13 points a second of a time (step S804). Therefore, a time is displayed with the hour hand 11, the minute hand 12, and the pointing hand 13.

Subsequently, the control unit 6 controls the motor driver 405 so that a pointing position of the distance display hand 43 is the position of zero of the scale 41*b* (step S805).

Subsequently, the control unit 6 acquires the residual ratio R of the secondary battery 62 from the battery residual quantity detection unit 4 and reads the minimum battery residual ratio level LT (=10%) of the time display mode from the relation table 5*a* (see FIG. 5) of the storage unit 5. Subsequently, the control unit 6 calculates the battery residual ratio RT in the time display mode using the following equation (2) (step S806).

$$RT=(R-LT)/(100\%-LT) \quad \text{Equation (2)}$$

For example, in a case in which the residual ratio R of the secondary battery 62 is 60%, the battery residual ratio RT in the time display mode is as follows from equation (1).

$$RT=(60\%-10\%)/(100\%-10\%)=56\%$$

In a case in which the execution operation mode is the time display mode, the control unit 6 may use the residual ratio R of the secondary battery 62 as the battery residual ratio RT in the time display mode.

Subsequently, the control unit 6 controls the motor driver 404 such that the residual quantity pointing hand 32 of the 2 o'clock side information display unit 30 points the battery residual ratio RT (step S807).

Figure 9:
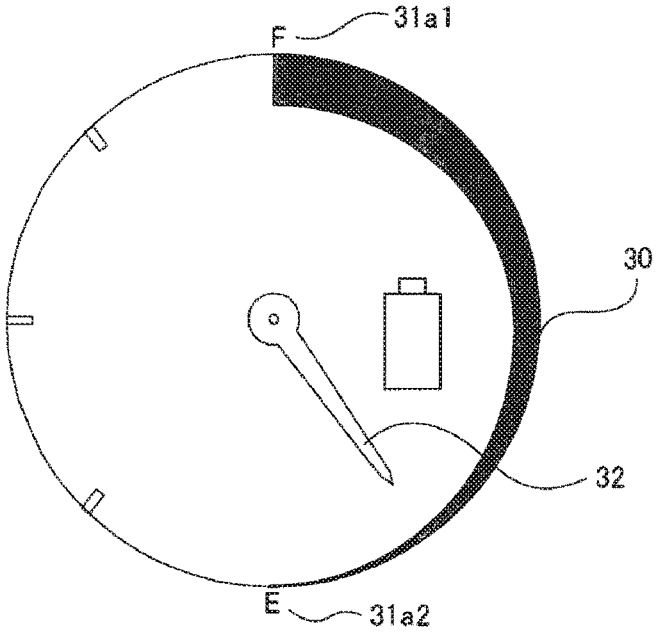
FIG. 9 is a diagram illustrating a display example of a battery residual ratio.

FIG. 9 is a diagram illustrating the battery residual ratio RN (=20%) in the navigation mode in a situation in which the residual ratio R of the secondary battery 62 is 60%.

Figure 10:
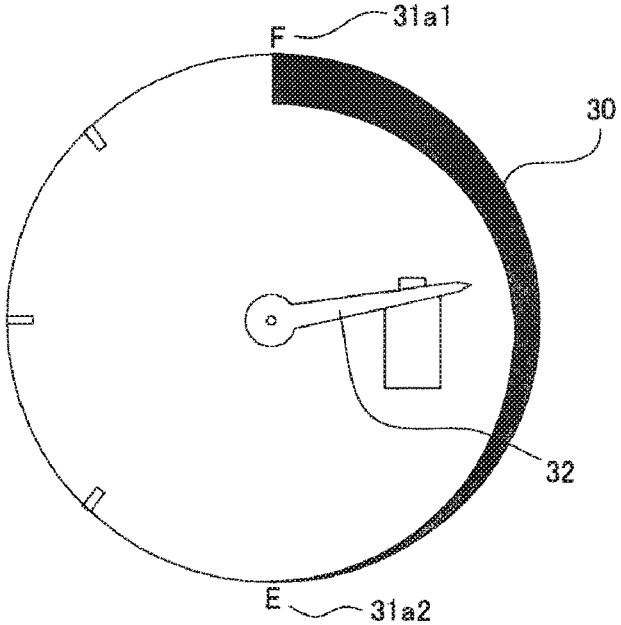
FIG. 10 is a diagram illustrating another display example of a battery residual ratio.

FIG. 10 is a diagram illustrating the battery residual ratio RT (=56%) in the time display mode in a situation in which the residual ratio R of the secondary battery 62 is 60%.

As illustrated in FIGS. 9 and 10, even when the residual ratio R of the secondary battery 62 is 60%, the battery residual ratio RN in the navigation mode and the battery residual ratio RT in the time display mode are different according to the minimum battery residual ratio level of each operation mode. As illustrated in FIGS. 9 and 10, the 2 o'clock side information display unit 30 displays the battery residual quantity according to the execution operation mode so that the battery residual quantity is easily understood intuitively since the battery residual ratio is switched according to the execution operation mode and the battery residual ratio is performed according to the execution operation mode.

When the residual ratio R of the secondary battery 62 is the minimum battery residual ratio level LT (=10%) of the time display mode, the control unit 6 stops the time display by the hour hand 11, the minute hand 12, and the pointing hand 13 in the time display unit 10 to lower power consumption. At this time, the control unit 6 continuously measures the time in the RTC 1.

According to the embodiment, since the display of the battery residual quantity is switched according to the execution operation mode, it is possible to realize display so that the actual battery residual quantity can be easily understood intuitively in each operation mode.

Since the display of zero of the battery residual quantity on the 2 o'clock side information display unit 30 corresponds to zero (the minimum battery residual ratio level) of the actual battery residual quantity in the operation mode, it is possible to realize display so that the actual battery residual quantity can be easily understood intuitively in each operation mode.

Even when the minimum battery residual ratio level of the time display mode is lower than the minimum battery residual ratio level of the navigation mode, the time display mode can be preferentially executed among the plurality of operation modes despite a small battery residual quantity. Therefore, the time display mode which is a basic function of a timepiece can be preferred to the other operation mode (the navigation mode).

Modification Examples of First Embodiment

The invention is not limited to the above-described embodiment. For example, various modification examples to be described below can be realized. Further, one modification example or a plurality of modification examples selected arbitrarily from the modification embodiments to be described below can also be appropriately combined.

Modification Example 1

In the above-described embodiment, the site registration switch A is continuously pressed in the departure site for the specific time or more, the departure site is registered as the destination site, and the navigation for returning to the departure site is subsequently executed.

However, in a case in which the navigation for returning to the departure site is executed, the control unit 6 may register each of a plurality of sites (way points) on a movement path of the user in the storage unit 5, use one of the plurality of registered sites as one destination site, and finally execute the navigation to the departure site while changing the site used as the destination site according to a user manipulation.

For example, in a state in which the coordinates of destination sites previously registered in the storage unit 5 are all cleared, the user continuously presses the site registration switch A in each of a plurality of sites on a movement path for a specific time or more and sequentially registers the coordinates of each site (the coordinates of each destination site) in the electronic timepiece W. AT this time, the control unit 6 gives a number corresponding to a procedure in which the site is registered to the coordinates of each site and stores the coordinates of the site to which the number is given in the storage unit 5.

For example, the control unit 6 gives a number "n" to the coordinates of an n-th registered site (where n is an integer equal to or greater than 1) and stores the coordinates of the site to which the number "n" is given in the storage unit 5.

FIG. 11 is a diagram illustrating an example of the destination site management table 5*b* in which the storage unit 5 manages coordinates of a site to which a number is given. In this case, a number is given in advance to the coordinates of each site (the coordinates of each destination site) registered before navigation is started.

For example, in a case in which both the site registration switch A and the navigation start switch B are pressed, the control unit 6 clears all of the coordinates of the sites to which the numbers are given (the coordinates of the destination site previously stored in the storage unit 5) and which are registered in the destination site management table 5*b*.

The control unit 6 performs navigation to a destination site using one of the plurality of registered sites as the destination site and further controls the motor driver 406 so that the number (n) given to the coordinates of the site used as the destination site is displayed in the date wheel 51.

For example, in a case in which the user sequentially registers the coordinates of n sites on one path in the electronic timepiece W (the storage unit 5), the control unit 6 first uses the coordinates of the site which is finally registered and to which the number "n" is given as a destination site (destination site information) and displays "n" in the date wheel 51 while executing the navigation to the site to which the number "n" is given. The number given to positional information used as destination site information may be displayed by a pointing hand (for example, the residual quantity pointing hand 32) rather than the date wheel 51.

Thereafter, when the user determines that the user returns to the site to which the number "n" is given according to the navigation of the electronic timepiece W, the user manipulates the navigation start switch B and the crown switch C (for example, presses the navigation start switch B in the state in which the crown switch C is extracted) and switches the destination site from the coordinates of the site to which the number "n" is given to the coordinates of a site to which a number "n−1" is given. According to this switching, the electronic timepiece W starts navigation to the site to which the number "n−1" is given. Hereinafter, navigation for returning to the departure site is executed by switching the destination site so that the number displayed in the date wheel 51 decreases one by one.

Modification Example 2

In the above-described embodiment, the control unit 6 registers the coordinates of the departure site (the destination site information) in the storage unit 5 according to a manipulation on the site registration switch A. However, the destination site information may be registered in advance in the storage unit 5. For example, the coordinates of a Mecca position may be registered in advance as the coordinates of the destination site in the storage unit 5. In this case, a qibla (the direction of a worship of Muslim) can be displayed as the direction of a destination site.

Modification Example 3

Figure 12:
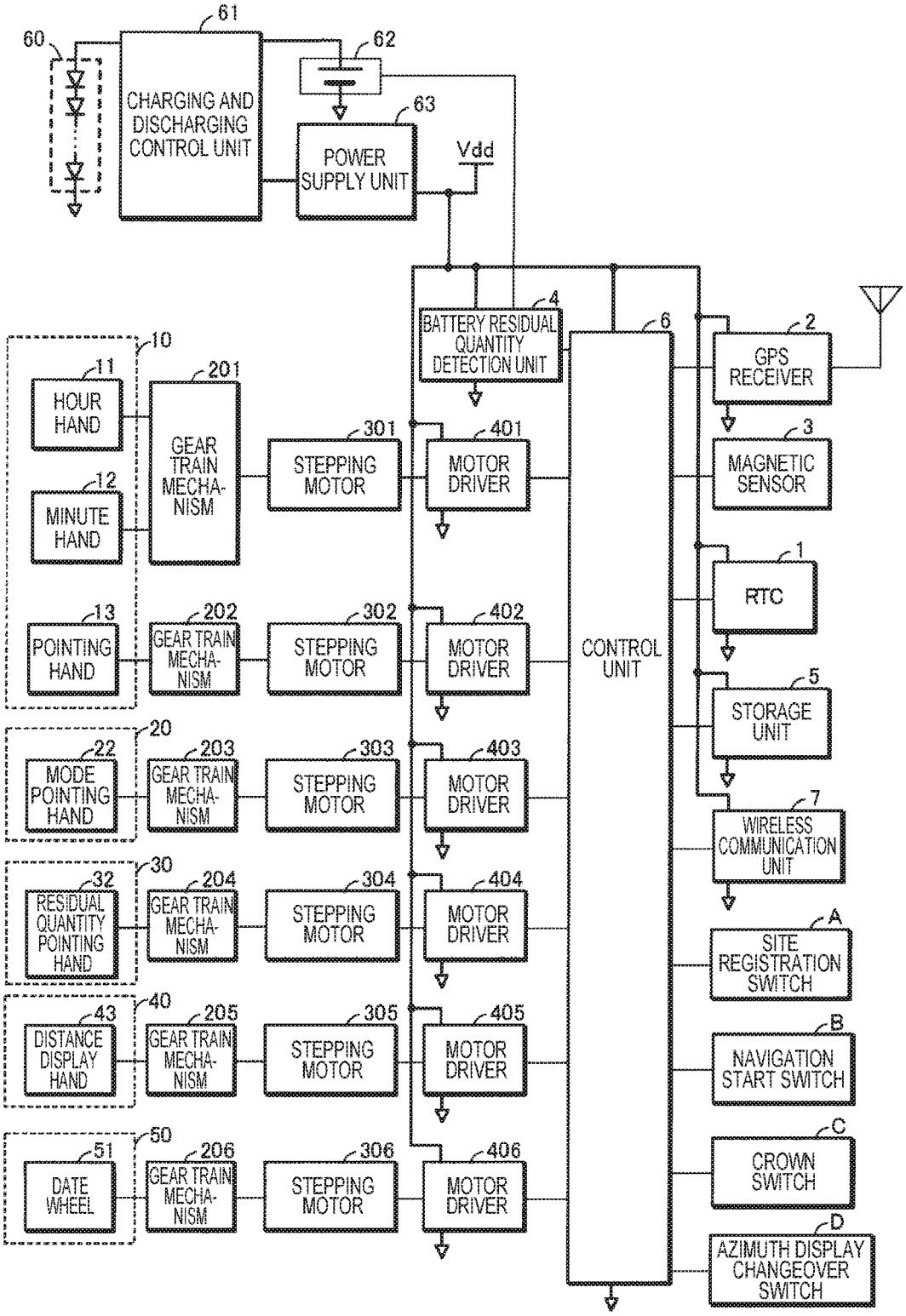
FIG. 12 is a diagram illustrating a configuration according to a modification example.

As illustrated in FIG. 12, the wireless communication unit 7 is installed in the electronic timepiece W. For example, the coordinates of a destination site may be registered via the wireless communication unit 7 from a communication device such as a smartphone.

Modification Example 4

In a case in which the execution operation mode is the navigation mode, the control unit 6 may estimate the number of times the navigation mode is executable according to a battery residual quantity and display the estimated number of times the navigation mode is executable as display of the battery residual quantity in the date display unit 50. In this case, a display unit that displays a battery residual quantity is configured by the 2 o'clock side information display unit 30 and the date display unit 50.

For example, the control unit 6 estimates the number of times the navigation mode is executable as follows.

The storage unit 5 stores power consumption quantity information indicating a power consumption quantity predicted to be consumed in the navigation mode of one time (hereinafter referred to as a "reference power consumption quantity") and maximum capacity information indicating a maximum value (hereinafter referred to as a "maximum capacity") of a battery capacity of the secondary battery 62.

When the navigation mode is executed as the execution operation mode, the control unit 6 estimates an executable number of times Nn of the navigation mode using Equation (4) below based on the battery residual ratio R detected by the battery residual quantity detection unit 4, the power consumption quantity information, the minimum battery residual ratio level LN of the navigation mode, and the maximum capacity information.

$$Nn=(\text{maximum capacity}\times(R-LN))/\text{reference power consumption quantity} \quad \text{Equation (4)}$$

Here, a value calculated in maximum capacity×(R−LN) indicates a power quantity usable in the navigation mode.

Whenever the navigation mode is executed as the execution operation mode, the control unit 6 may measure a power consumption quantity consumed in the navigation mode of one time using a measurement instrument (not illustrated) and store the measurement result in the storage unit 5. In a case in which the navigation mode is executed as the execution operation mode in a situation in which measurement results is stored in the storage unit 5, an average value of the measurement results may be used as a reference power consumption quantity.

Second Embodiment

Figure 13:
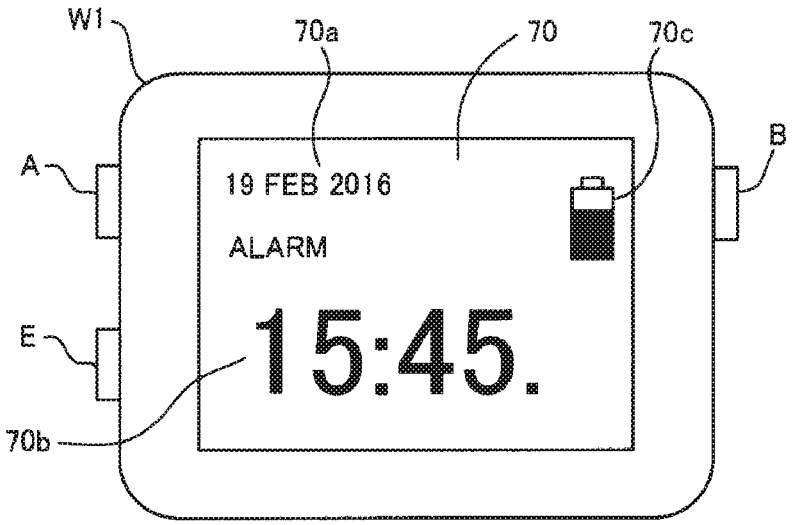
FIG. 13 is a plan view illustrating an electronic timepiece according to a second embodiment.
Figure 14:
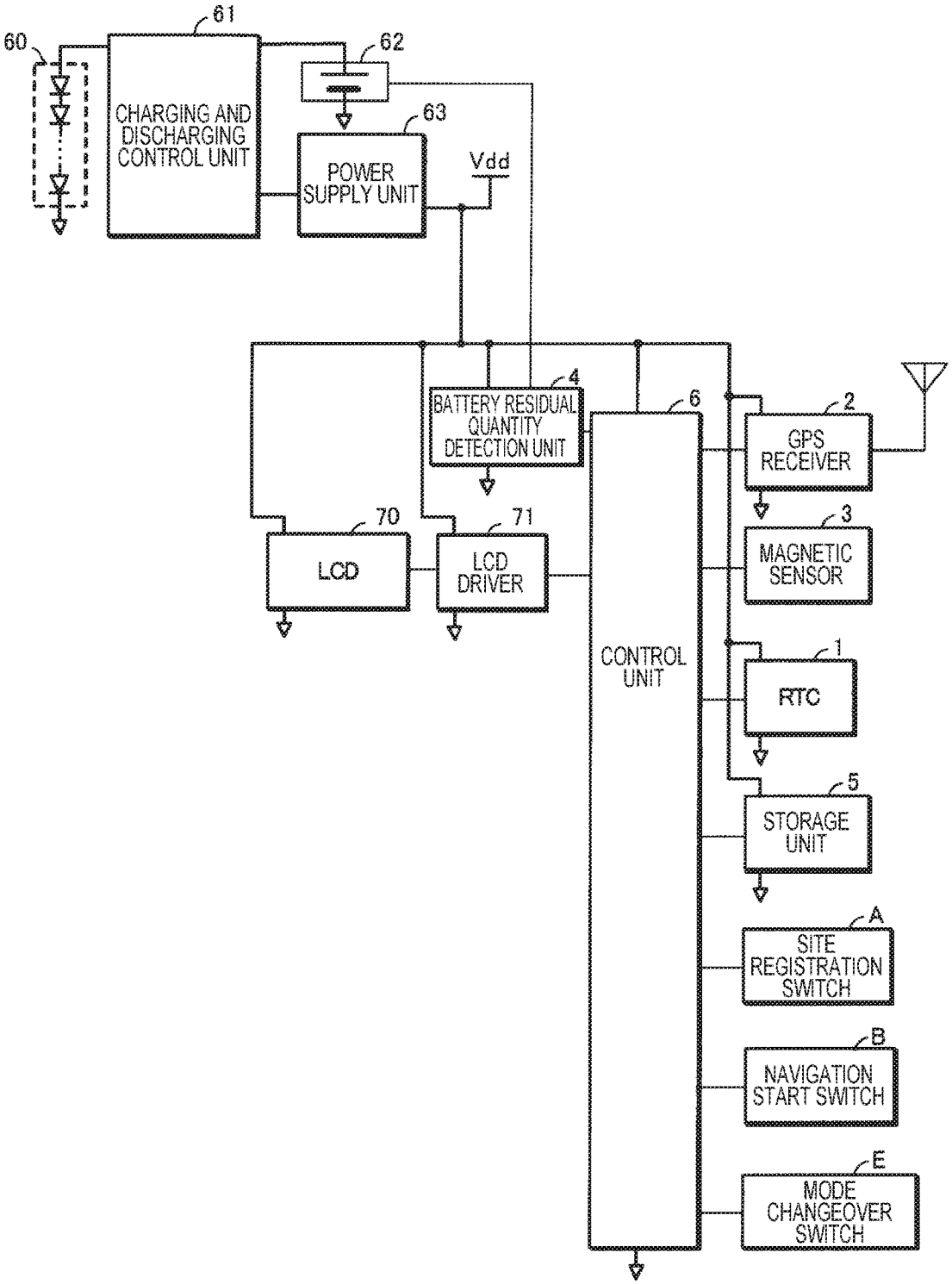
FIG. 14 is a diagram illustrating the configuration of the electronic timepiece.

FIG. 13 is a plan view illustrating an electronic timepiece W1 according to a second embodiment. In other words, FIG. 13 is a plan view illustrating the electronic timepiece W1 in a time display mode. FIG. 14 is a diagram illustrating the configuration of the electronic timepiece W1. In FIGS. 13 and 14, the same reference numerals are given to the same constituent elements as those illustrated in FIGS. 1 and 4.

Main differences between the electronic timepiece W1 of the second embodiment and the electronic timepiece W of the first embodiment are as follows.

First, the electronic timepiece W1 includes a liquid crystal display (LCD) 70 and an LCD driver 71 instead of the time display unit 10, the 6 o'clock side information display unit 20, the 2 o'clock side information display unit 30, the 10 o'clock side information display unit 40, the date display unit 50, the gear train mechanisms 201 to 206, the stepping motors 301 to 306, the motor drivers 401 to 406.

The electronic timepiece W1 has a compass mode in addition to the time display mode and the navigation mode as operation modes.

The electronic timepiece W1 includes a mode changeover switch E and does not include the crown switch C and the azimuth display changeover switch D.

The electronic timepiece W1 has the configuration of the above-described modification example 1 (for example, the coordinates of a site to which a number is given are managed, navigation is executed using the site as a destination site, and the number of the site used as the destination site is displayed). A manipulation of pressing both the site registration switch A and the mode changeover switch E is used as the manipulation of switching the destination site from the coordinates of a site to which the number "n" is given to the coordinates of a site to which the number "n−1" is given.

The LCD 70 is an example of a digital display. The LCD driver 71 drives the LCD 70. The LCD 70 and the LCD driver 71 use an internal power voltage Vdd as a power voltage.

The compass mode is a mode in which the LCD 70 indicates the direction of the due north.

The mode changeover switch E is used to switch the execution operation mode of the electronic timepiece W1. Whenever the control unit 6 detects a manipulation of pressing the mode changeover switch E, the control unit 6 switches the execution operation mode of the electronic timepiece W1 from the "time display mode" to the "compass mode", from the "compass mode" to the "navigation mode", and from the "navigation mode" to the "time display mode". In the electronic timepiece W1, the time display mode is set as the execution operation mode in an initial state.

Figures 15, 16:
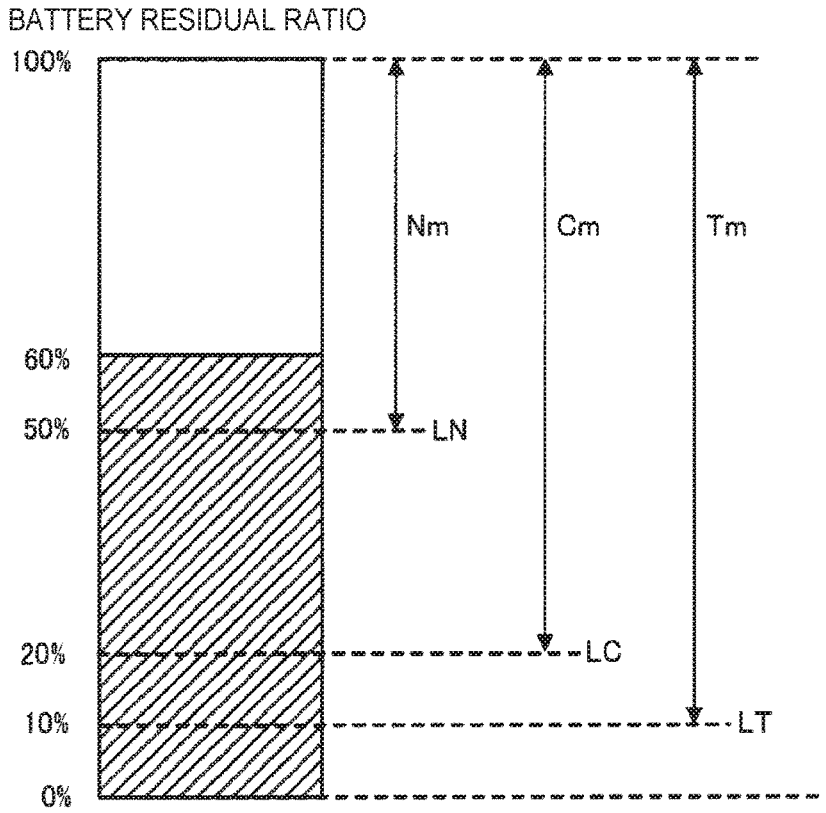
FIG. 15 is a diagram illustrating an example of a relation table.
FIG. 16 is a diagram illustrating a minimum battery residual ratio level of each operation mode.

FIG. 15 is a diagram illustrating an example of a relation table 5*c* recorded by the storage unit 5 of the electronic timepiece W1.

In the relation table 5*c* illustrated in FIG. 15, the time display mode, the compass mode, and the navigation mode are set as operation modes, 10% is set as a minimum battery residual ratio level LT of the time display mode, 20% is set as a minimum battery residual ratio level LC of the compass mode, and 50% is set as a minimum battery residual ratio level LN of the navigation mode. Therefore, the minimum battery residual ratio level LT of the time display mode is lower than a minimum level of the battery residual ratios of the operation modes (the compass mode and the navigation mode) other than the time display mode among the plurality of operation modes.

The minimum battery residual ratio level LT of the time display mode is not limited to 10%, but can be appropriately changed. The minimum battery residual ratio level LC of the compass mode is not limited to 20%, but may be higher than the minimum battery residual ratio level LT of the time display mode. The minimum battery residual ratio level LN of the navigation mode is not limited to 50%, but may be higher than the minimum battery residual ratio level LT of the time display mode.

FIG. 16 is a diagram illustrating relation among the minimum battery residual ratio level LT (=10%) of the time display mode, the minimum battery residual ratio level LC (=20%) of the compass mode, and the minimum battery residual ratio level LN (=50%) of the navigation mode.

In the example illustrated in FIG. 16, the time display mode can be executed between the battery residual ratios of 100% to 10% (a range Tm illustrated in FIG. 16). The compass mode can be executed between the battery residual ratios of 100% to 20% (a range Cm illustrated in FIG. 16). The navigation mode can be executed between the battery residual ratios of 100% to 50% (a range Nm illustrated in FIG. 16). In FIG. 16, the battery residual ratio of 60% is also illustrated.

Time Display Mode

In the case in which the execution operation mode is the time display mode, the control unit 6 stops the operations of the magnetic sensor 3 and the GPS receiver 2 and operates at power consumption lower than in a case in which the magnetic sensor 3 or the GPS receiver 2 operates.

Further, in the case in which the execution operation mode is the time display mode, for example, as illustrated in FIG. 13, the control unit 6 controls the LCD driver 71 so that the LCD 70 displays a calendar 70*a*, a time 70*b*, and a battery residual quantity (battery residual ratio) 70*c*.

At this time, the control unit 6 displays the residual ratio R of the secondary battery 62 detected by the battery residual quantity detection unit 4 as the battery residual quantity 70*c*. For example, in a case in which the residual ratio R of the secondary battery 62 is 60%, 60% is displayed as the battery residual quantity 70*c*.

The display of the LCD 70 in a situation in which the execution operation mode is the time display mode is not limited to the display illustrated in FIG. 13 and can be appropriately changed. For example, the LCD 70 may display only the time 70*b* and the battery residual quantity (battery residual ratio) 70*c*.

Compass Mode

Figure 17:
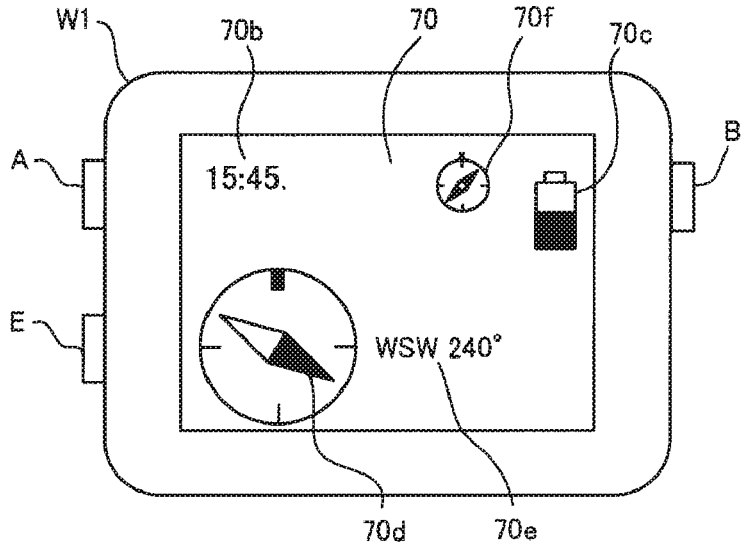
FIG. 17 is a diagram illustrating a display example in a compass mode of the electronic timepiece.

In the case in which the execution operation mode is the compass mode, the control unit 6 specifies the direction of the north by activating the magnetic sensor 3 and measuring the direction of geomagnetism using the magnetic sensor 3 and controls the LCD driver 71 such that the LCD 70 displays a north direction 70*d*, an azimuth 70*e* in which the electronic timepiece W1 is oriented (the west-southwest of 240° in FIG. 17), a compass mode display 70*f*, the time 70*b*, and the battery residual quantity (battery residual ratio) 70*c*, for example, as illustrated in FIG. 17.

At this time, the control unit 6 displays the battery residual quantity (battery residual ratio) 70*c* in a case in which the residual ratio R of the secondary battery 62 is equal to or greater than the minimum battery residual ratio level of the compass mode. Additionally, the control unit 6 can transfer the execution operation mode of the electronic timepiece W1 to the compass mode in a case in which the residual ratio R of the secondary battery 62 is equal to or greater than the minimum battery residual ratio level of the compass mode.

For example, the control unit 6 calculates a battery residual ratio RC in the compass mode using Equation (3) below.

$$RC=(R-LC)/(100\%-LC) \qquad \text{Equation (3)}$$

Here, LC (a minimum battery residual ratio level LC of the compass mode) in Equation (3) is 20% in the example illustrated in FIG. 15.

For example, in a case in which the residual ratio R of the secondary battery 62 is 60%, the battery residual ratio RC in the compass mode is as follows from Equation (3).

$$RC=(60\%-20\%)/(100\%-20\%)=50\%$$

The display of the LCD 70 in a situation in which the execution operation mode is the compass mode is not limited to the display illustrated in FIG. 16 and can be appropriately changed.

Navigation Mode

In the case in which the execution operation mode is the navigation mode, the control unit 6 activates the GPS receiver 2, receives satellite signals, and acquires the coordinates of the current site using the satellite signals whenever the navigation start switch B is pressed.

Subsequently, the control unit 6 calculates the distance up to the destination site and the azimuth of the destination site using the coordinates of the current site and the destination site information. In the example illustrated in FIG. 18, the control unit 6 uses the coordinates of a site to which a number "3" 70*g* displayed in the LCD 70 is given as the destination site information.

Subsequently, the control unit 6 decides the north direction by activating the magnetic sensor 3 and measuring the direction of magnetism using the magnetic sensor 3. At this time, the control unit 6 corrects the direction of the magnetic north measured by the magnetic sensor 3 using information regarding a declination angle stored in advance in the storage unit 5 and decides the direction of the due north. In a case in which the storage unit 5 stores a declination angle table indicating a relation between a declination angle and position coordinates, the control unit 6 may read a declination angle corresponding to the coordinates of a current site from the declination angle table, correct the direction of the magnetic north using the read declination angle, and decide the direction of the due north. Subsequently, the control unit 6 decides the direction of the destination site based on the direction of the north and the azimuth of the destination site.

Figure 18:
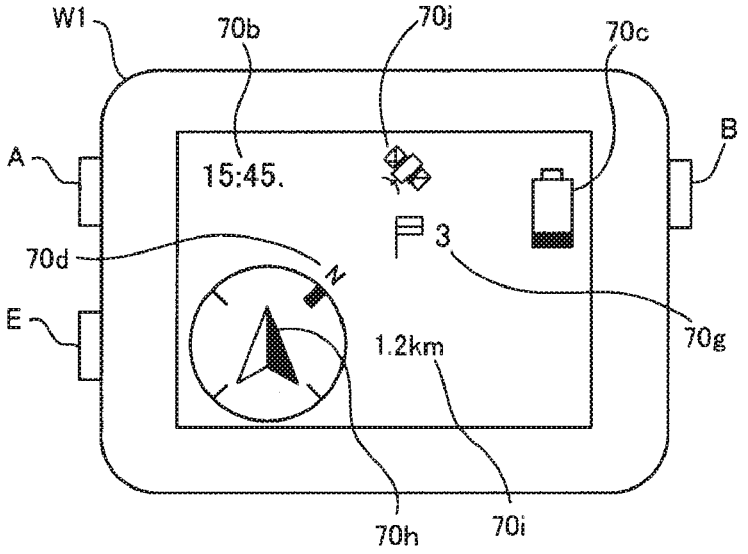
FIG. 18 is a diagram illustrating a display example in a navigation mode of the electronic timepiece.

Subsequently, for example, as illustrated in FIG. 18, the control unit 6 controls the LCD driver 71 such that the LCD 70 displays the north direction 70*d*, a direction 70*h* of the destination site, a distance 70*i* up to the destination site, the time 70*b*, the battery residual quantity 70*c*, a number 70*g*, navigation mode display 70*j*.

At this time, in a case in which the residual ratio R of the secondary battery 62 is equal to or greater than the minimum battery residual ratio level of the navigation mode, the control unit 6 displays the battery residual quantity 70*c*. Additionally, in a case in which the residual ratio R of the secondary battery 62 is equal to or greater than the minimum battery residual ratio level of the navigation mode, the control unit 6 can transfer the execution operation mode of the electronic timepiece W1 to the navigation mode.

For example, the control unit 6 calculates the battery residual ratio RN in the navigation mode using Equation (1) above.

For example, in a case in which the residual ratio R of the secondary battery 62 is 60%, the battery residual ratio RN in the navigation mode is as follows from Equation (1) described above.

$$RN=(60\%-50\%)/(100\%-50\%)=20\%$$

The display of the LCD 70 in a situation in which the execution operation mode is the navigation mode is not limited to the display illustrated in FIG. 18 and can be appropriately changed.

In the embodiment, for example, as illustrated in FIG. 13 (corresponding to the time display mode), FIG. 17 (corresponding to the compass mode), and FIG. 18 (corresponding to the navigation mode), a display form of the battery residual quantity 70*c* is different for each operation mode even in a case in which the residual ratio R of the secondary battery 62 is identical. Specifically, the display form of the battery residual quantity 70*c* is switched according to the minimum battery residual ratio level of the operation mode which is the execution operation mode. Therefore, it is possible to realize display so that the actual battery residual quantity can be easily understood intuitively in each operation mode.

Modification Example of Second Embodiment

The invention is not limited to the above-described embodiments. For example, various modification examples to be described below can also be realized. Further, one modification example or a plurality of modification examples selected arbitrarily from the modification embodiments to be described below can also be appropriately combined.

Modification Example 1

In the embodiment, the modification examples (for example, Modification Examples 2 to 4) described in the first embodiment may be realized. In a case in which Modification Example 4 is modified in the second embodiment, the control unit 6 controls the LCD driver 71 such that the number of times the navigation mode is executable (estimated value) is displayed on the LCD 70.

The entire disclosure of Japanese Patent Application No. 2016-063675, filed Mar. 28, 2016 is expressly incorporated by reference herein.

What is claimed is:

1. An electronic timepiece comprising:

a battery that is configured to supply power to components in the electronic timepiece;

a battery residual amount detection circuit that is configured to detect a residual amount of the battery;

a display that is configured to display a plurality of battery residual amount indicators each corresponding to the detected residual amount of the battery;

a memory that is configured to store computer-readable instructions; and a processor that is configured to execute the computer-readable instructions so as to:

select one of a plurality of operations of the electronic timepiece, the plurality of operations including a time display operation and a navigation operation; and switch from a first indicator of the plurality of battery residual amount indicators to a second indicator of the plurality of battery residual amount indicators when the processor selects the navigation operation and exits the time display operation, wherein when the processor selects the navigation operation, the processor is configured to estimate the number of future executable times of the navigation operation based on the detected residual amount of the battery so that the processor is configured to display the estimated future executable times as the second indicator in the display.

2. The electronic timepiece according to claim 1, further comprising:

an input device that is configured to receive an input from a user, wherein the processor is configured to select one of the plurality of operations of the electronic timepiece based on the input.

3. The electronic timepiece according to claim 1, wherein the plurality of operations have a plurality of operable minimum battery residual amounts, respectively, that are different from each other, and the plurality of operable minimum battery residual amounts have first and second operable minimum battery residual amounts, the plurality of operable minimum battery residual amounts correspond to a plurality of battery residual amount scales for the plurality of battery residual amount indicators, respectively, and the plurality of battery residual amount scales have first and second scales corresponding to the first and second indicators and corresponding the first and second operable minimum battery residual amounts, and when the processor selects the navigation operation and exits the time display operation, the processor switches from the first scale to the second scale for displaying the second indicator for the navigation operation.

4. The electronic timepiece according to claim 3, wherein when the processor is configured to detect that the battery residual amount of each of the plurality of operations reaches corresponding one of the plurality of operable minimum battery residual amounts, the processor is configured display zero in the display as corresponding one of the plurality of battery residual amount indicators.

5. The electronic timepiece according to claim 3, wherein the first operable minimum battery residual amount is smaller than the second operable minimum battery residual amount.

6. An electronic timepiece comprising:

a battery that is configured to supply power to components in the electronic timepiece;

a battery residual amount detection circuit that is configured to detect a residual amount of the battery;

a display that is configured to display a plurality of battery residual amount indicators each corresponding to the detected residual amount of the battery;

a memory that is configured to store computer-readable instructions; and a processor that is configured to execute the computer-readable instructions so as to:

select one of a plurality of operations of the electronic timepiece, the plurality of operations including a first operation and a second operation; and switch from a first indicator of the plurality of battery residual amount indicators to a second indicator of the plurality of battery residual amount indicators when the processor selects the second operation and exits the first operation, wherein the plurality of operations have a plurality of operable minimum battery residual amounts, respectively, that are different from each other, and the plurality of operable minimum battery residual amounts have first and second operable minimum battery residual amounts, the plurality of operable minimum battery residual amounts correspond to a plurality of battery residual amount scales for the plurality of battery residual amount indicators, respectively, and the plurality of battery residual amount scales have first and second scales corresponding to the first and second indicators and corresponding the first and second operable minimum battery residual amounts, and when the processor selects the second operation and exits the first operation, the processor switches from the first scale to the second scale for displaying the second indicator for the second operation.

7. The electronic timepiece according to claim 6, further comprising:

an input device that is configured to receive an input from a user, wherein the processor is configured to select one of the plurality of operations of the electronic timepiece based on the input.

8. The electronic timepiece according to claim 6, wherein when the processor is configured to detect that the battery residual amount of each of the plurality of operations reaches corresponding one of the plurality of operable minimum battery residual amounts, the processor is configured display zero in the display as corresponding one of the plurality of battery residual amount indicators.

9. The electronic timepiece according to claim 6, wherein the first operable minimum battery residual amount is smaller than the second operable minimum battery residual amount.

* * * * *